United States Patent [19]

Tinti

[11] Patent Number: 4,601,144

[45] Date of Patent: Jul. 22, 1986

[54] BUILDING INSULATING AND TRIMMING SYSTEM

[76] Inventor: Jerome Tinti, W249 S8540 Center Rd., Mukwonago, Wis. 53149

[21] Appl. No.: 658,528

[22] Filed: Oct. 9, 1984

[51] Int. Cl.[4] ..... E06B 1/04; E06B 1/62; E04F 19/04

[52] U.S. Cl. ..... 52/211; 52/287; 52/288; 52/309.8; 52/395; 52/716

[58] Field of Search ..... 52/211, 212, 287, 288, 52/290, 716, 276, 309.8, 395, 469, 468; 49/505

[56] References Cited

U.S. PATENT DOCUMENTS

| | | | |
|---|---|---|---|
| 503,426 | 8/1893 | Knower | 52/395 |
| 2,124,775 | 7/1938 | Haugaard | 52/211 |
| 2,840,203 | 6/1958 | Hehr | 52/214 X |
| 3,167,823 | 2/1965 | Palfrey | 52/309.3 X |
| 3,239,977 | 3/1966 | Shore | 52/204 |
| 3,256,663 | 6/1966 | Bishop | 52/288 X |
| 3,298,147 | 1/1967 | Haberman | 52/287 |
| 3,305,983 | 2/1967 | Bus | 52/243.1 |
| 3,520,085 | 7/1970 | Pond | 52/212 X |
| 3,724,136 | 4/1973 | Forsberg | 49/505 |
| 4,150,517 | 4/1979 | Warner, Sr. | 52/288 |

FOREIGN PATENT DOCUMENTS

| | | | |
|---|---|---|---|
| 246877 | 9/1963 | Australia | 52/395 |
| 625115 | 8/1961 | Canada | 52/276 |
| 690554 | 7/1964 | Canada | 52/288 |
| 2420228 | 11/1975 | Fed. Rep. of Germany | 49/505 |
| 845026 | 8/1960 | United Kingdom | 52/288 |

*Primary Examiner*—Alfred C. Perham
*Attorney, Agent, or Firm*—Lee, Smith & Zickert

[57] ABSTRACT

A system for trimming, insulating and sealing between two separate elements of a building structure. The system includes an elongated strip of material, such as wood, having a channel on its reverse side which is wider than the width of a gap in the building structure which is to be covered by the strip. A compressible insulant, such as foam, is disposed in the channel and, like the channel, has a width greater than the width of the gap so that the insulant seals between the two building elements when the strip is installed. The insulant extends outwardly from the channel so that it is compressed when the strip is installed.

9 Claims, 6 Drawing Figures

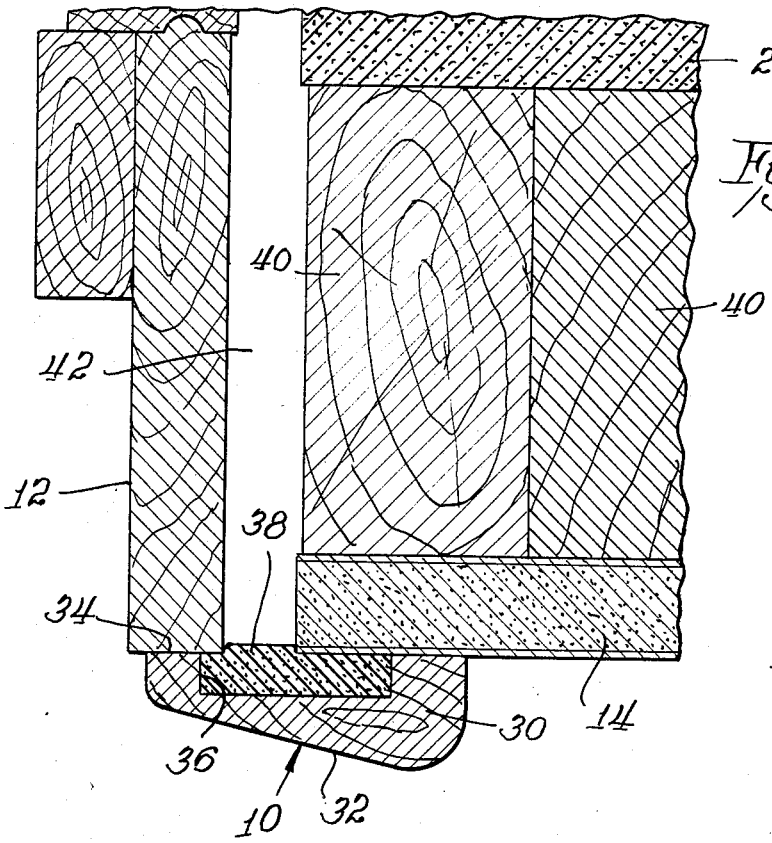
Fig. 4.
Fig. 6.
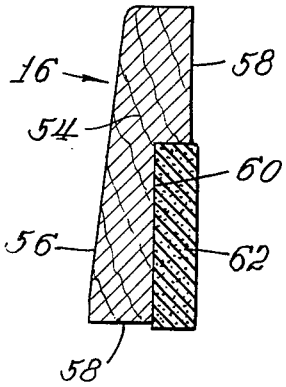
Fig. 5.
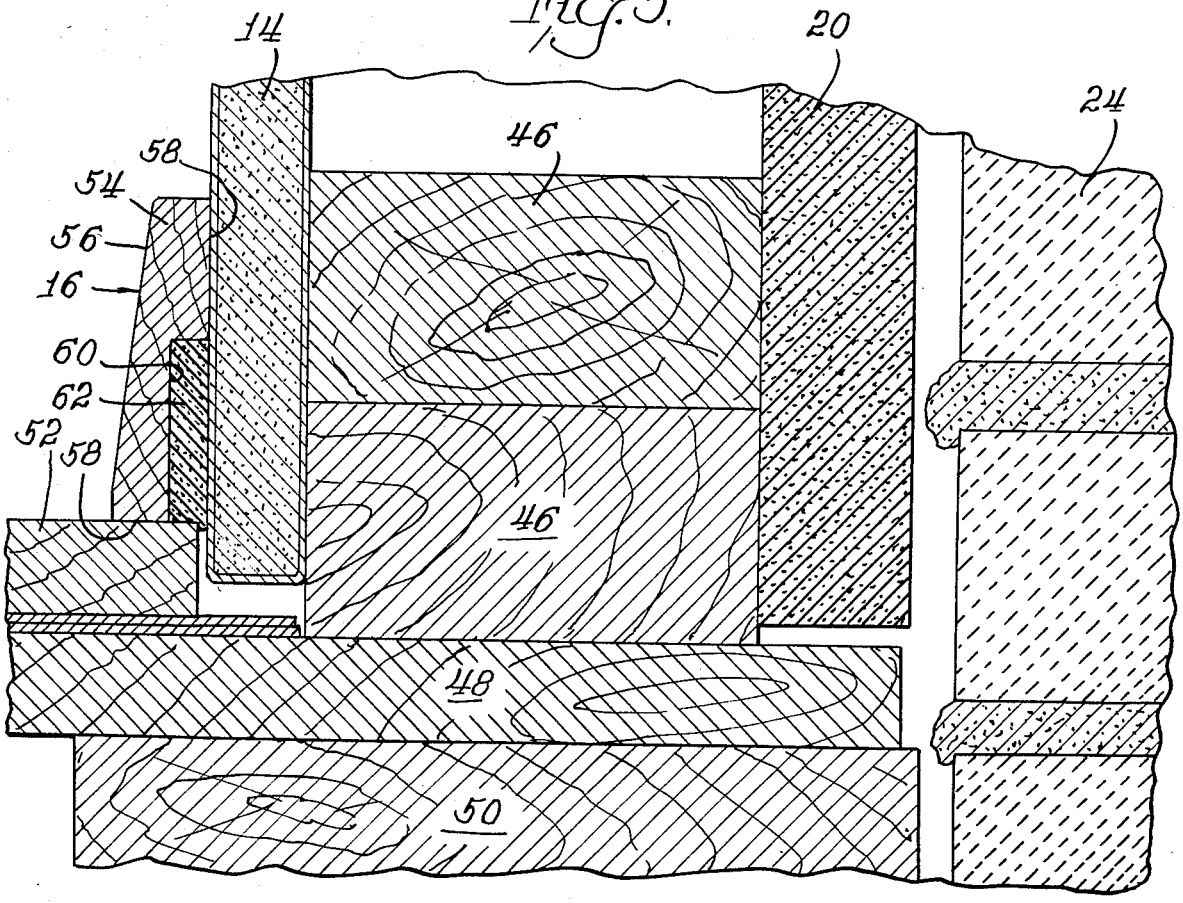

BUILDING INSULATING AND TRIMMING SYSTEM

BACKGROUND OF THE INVENTION

This invention relates to building structures, and in particular to a molding or the like for trimming, insulating and sealing between two separate elements of a building structure.

When buildings are constructed, tolerances are necessary to accommodate variations between building elements, such as between walls and windows, walls and floors, and walls and doors. However, when tolerances occur, gaps between the two building elements provide a natural path for the influx or egress of air, which is quite undesirable when the building is either heated or cooled to maintain a certain creature comfort in the building different from the ambient temperature at the building exterior.

Typically, and in particular in home construction, gaps on outside walls between windows, doors and floors are either caulked or stuffed with fiberglass insulation, or both, to largely prevent air filtration and provide insulation between the two building elements. However, caulking tends to age and crack with time, and is impractical for large gaps. While stuffed fiberglass insulation provides a seal for such gaps, one must be knowledgable when stuffing the fiberglass, for if it is packed too tightly, the insulation value is greatly diminished, and if it is not packed properly, air can still flow past the fiberglass, therefore rendering it ineffective. In addition, any time that such fiberglass must be used, its installation is time-consuming and therefore labor-intensive, a costly endeavor which is to be avoided if possible. Therefore, many times such gaps are not filled or sealed at all.

Foams have become popular for filling such gaps in building structures, the foam normally being applied from a pressurized source to the gap where the foam expands many times its volume in the gap to fill the gap. However, again, applying the foam is a time-consuming endeavor, which makes it quite expensive. In addition, the foam itself is expensive and because of uneven expansion, it normally must be manually trimmed after it drys, again adding to the cost of the installation. In addition, since the foam normally adheres to whatever surface it touches, if errors are made or if future remodeling occurs, the foam is difficult to remove.

Many efforts have, in the past, been made to provide a trim of some nature between two building sections, normally between a window or door and the adjacent wall structure. Such efforts typically involve a unique style or design of the trim element or a special trim material, such as metal. Examples of such prior art are U.S. Pat. Nos. 3,724,136; 3,520,085; 2,124,775 and 3,256,663. In the latter-mentioned patent, sealing strips are employed, but seal to a single element of an insulated wall, such as to the wall or to the floor. The metal nature of the channel holding the sealing material is heat conductive and difficult to work with while the sealing material itself does not extend beyond the surface of the metal in which it is located, thus providing an ineffective seal should there be surface imperfections or a failure for elements to align exactly.

Other efforts of the prior art to develop a sealing material usually involve a unique method of affixing or mounting a trimmed piece. The following patents are examplary of such methods: U.S. Pat. Nos. 2,840,203; 2,124,775; 3,305,983; 3,298,147; 4,150,517 and British Pat. No. 845,026 of Aug. 17, 1960.

In other efforts to provide insulation by the prior art, the insulation or weather stripping is visible, providing an unsightly feature if, as is typical, the insulation is not meant to be in full view. The following patents exemplify such structure: U.S. Pat. Nos. 3,520,085; 2,840,203; 3,239,977; 2,124,775 and 3,167,823 (which in addition, is not directed to a building structure).

SUMMARY OF THE INVENTION

The present invention overcomes the above-delineated disadvantages of the prior art and others by providing a system for trimming, insulating and sealing between two separate building elements which does not involve any unique method of affixing or mounting, does not involve a unique style or design of the trim material, and is invisible when installed. The system according to the invention insulates or weather strips by spanning a gap between two building elements, such as either a window frame or floor and the wall, and can be attached by conventional means, such as by nailing or screwing.

In accordance with the invention, the system comprises an elongated strip having a facing side and an insulating side, the strip having a width greater than the width of a gap between two separate building elements. The facing side comprises a visible side of the strip to provide an asthetic trim between the building elements. The insulating side comprises an invisible side of the strip when installed, and includes a channel extending the length of the strip. The channel has a width greater than the width of the gap and a particular constant and predetermined depth. A compressible insulant is disposed in the channel, the insulant having a width greater than the width of the gap between the two building elements and a thickness greater than the depth of the channel such that the insulant extends outwardly from the channel to conform to and provide a seal upon contact with the building elements, without the building elements needing to be precisely aligned with one another.

In accordance with the invention, the two building elements are either a window and a wall, a door and a wall, or a floor and a wall, and the strip and insulant in the strip span an interior gap between the wall and the other building elements.

For sealing between a wall and a floor, the insulating side of the strip comprises two generally orthogonal surfaces of the strip, and the insulant extends outwardly from the channel beyond each of the two surfaces. For sealing between a window or door and the wall, the insulating side is generally planar, and the portion of the insulant which extends outwardly from the channel includes a planar contact surface which is substantially parallel to the insulating side.

In all embodiments of the invention, the insulant is adhesively secured in the channel, either by self-adhesion or with an appropriate adhesive which is applied to the channel before the insulant is installed. Preferably, the insulant is a foamed insulant, which has suitable properties of compressibility and insulation while being able to readily conform to whatever surface it abuts.

BRIEF DESCRIPTION OF THE DRAWINGS

The invention is described in greater detail in the following description of the preferred embodiments, taken in conjunction with the drawings, in which:

FIG. 4 is an enlarged cross-sectional view taken along lines 4—4 of FIG. 1, FIG. 5 is an enlarged cross-sectional view taken along lines 5—5 of FIG. 1, and FIG. 6 is a cross-sectional view of a second embodiment of the invention.

DESCRIPTION OF EXAMPLES EMBODING THE BEST MODE OF THE INVENTION

Figure 1:
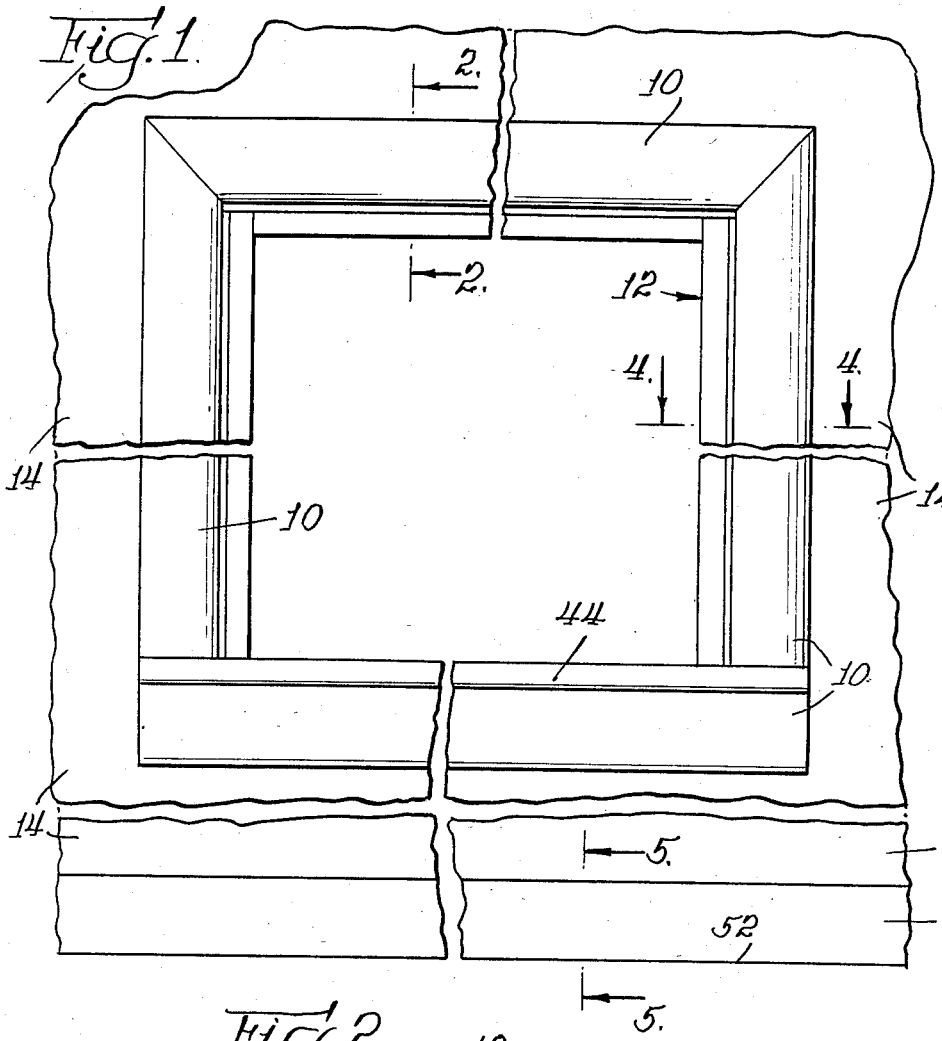
FIG. 1 is a broken elevational view showing use of the invention for trimming, insulating and sealing between elements of a building structure.
Figure 3:
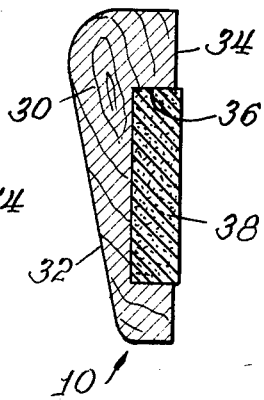
FIG. 3 is a cross-sectional view of one embodiment of the invention.
Figure 2:
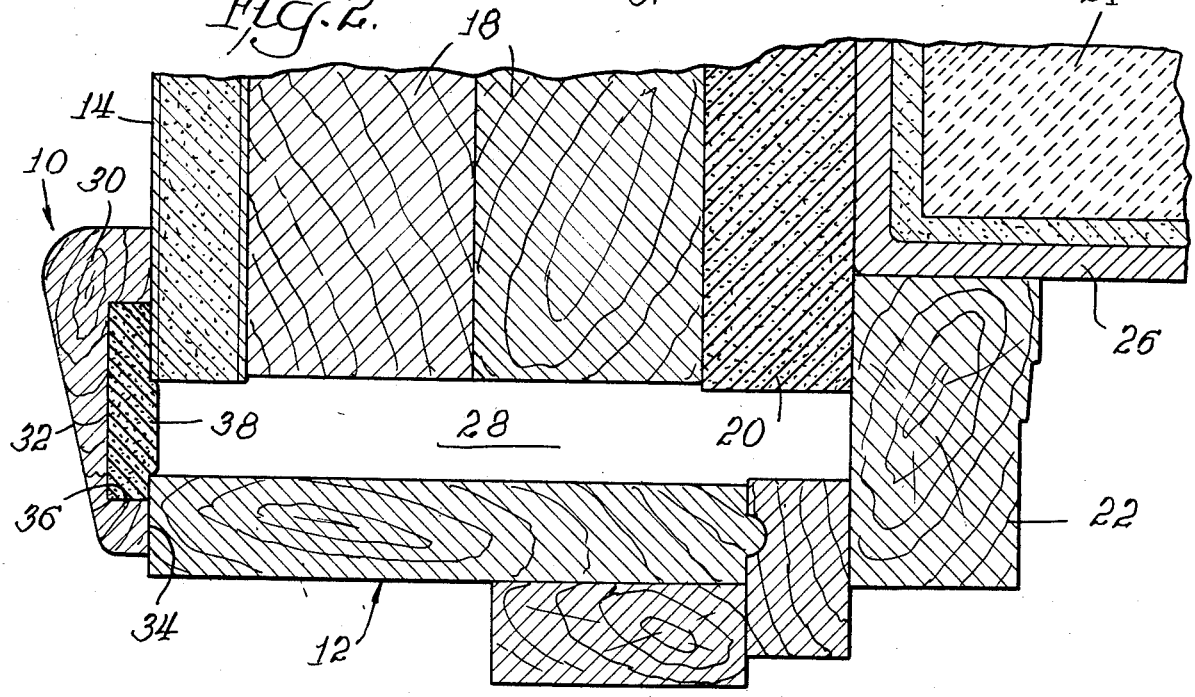
FIG. 2 is an enlarged cross-sectional view taken along lines 2—2 of FIG. 1.

Over all use of the invention is illustrated in FIG. 1, with enlarged cross-sectional views of the invention being shown in FIGS. 2, 4 and 5, and cross-sectional views of the sealing strips themselves (in the form of a door/window molding or baseboard, respectively) being shown in FIGS. 3 and 6. Also, as illustrated in the drawings and discussed in greater detail in the following description, the invention is shown used in connection with a building structure having a brick facade. As is evident from the nature of the invention, the facade forms no part of the invention, and is shown for illustration purposes only. Also, the discussion below with regard to the particular embodiment of the invention shown in FIGS. 2, 3 and 4 is with particular reference to trimming, insulating and sealing between a window and a wall. That embodiment of the invention could, as well, be used for the same purposes between a door and a wall, or any other similar structure.

FIG. 1 illustrates two examples of installation of the invention, first as a molding or casing 10 between a window (or equivalently, a door) 12 and a wall 14 and also as a floor baseboard 16 between the wall 14 and a floor (not illustrated in FIG. 1). Use and installation of the molding 10 is better illustrated in FIGS. 2 through 4, while use and installation of the baseboard 16 is better illustrated in FIGS. 5 and 6.

In FIG. 2, illustrated is a typical cross-section through a building at the top of the window 12. From left to right, the building includes the interior wall 14, double headers 18, exterior sheathing (such as a foam sheet) 20, an exterior window molding 22, an exterior brick building facade 24, and an iron support lintel 26 to support the brick 24 above the window 12. As is typical in installations of the nature of the present invention, the window 12 is obtained as a modular unit including the exterior molding 22 which is installed in a rough opening in the building defined by a gap 28 between the installed window 12 and the headers 18 and sheathing 20. The gap 28 is typically one-half inch (1.25 centimeters) or more, in order to provide a construction tolerance and facilitate easy installation of the window 12 within its rough opening.

In a typical prior art installation, after the window 12 is installed, the wall 14 is applied and finally, a finish molding or casing such as the molding 10 is installed to cover the gap 28. Before the molding is installed, the gap may be stuffed with fiberglass or other types of insulation, or as has often been the case, the gap is left open. Thus, since the finish molding has, in the past, not served as an insulating and sealing means, air can readily enter the building through the gap 28, creating a greater than necessary demand on the building's heating plant.

In accordance with the invention, in order to seal the gap 28 between the window 12 and the wall 14, a finish molding in the form of the molding 10 is installed. As best shown in FIG. 3, the molding 10 includes an elongated strip 30 having a facing side 32 and an insulating side 34. The facing side 32 is the visible side of the strip 30 and provides an asthetic trim between the wall 14 and window 12. The insulating side 34 is visible when installed, and includes a channel 36 extending the length of the strip 30. The channel 36 has a width greater than the width of the gap 28 so that, when installed as shown in FIG. 2, the channel 36 easily spans the gap 28. The depth of the channel 36 may vary, but preferably is as deep as possible to include as much insulation as possible without detracting from the necessary structural strength of the molding 10.

A compressible insulant 38 is located in the channel 36. Preferably, the insulant 38 is a foam or other similar insulant which has a cellular structure and therefore easily accomodates unevenness in either the window 12 or wall 14 such as joints between members, nicks or gouges, or other slight gaps or protrusions which do not form a smooth, continuous surface. As best shown in FIG. 3, the insulant 38 extends outwardly from the molding 10 beyond the plane of the surface of the insulating side 34. Since the insulant 38 is compressible, as mentioned above, when the molding 10 is installed, the protruding insulant 38 provides a firm and effective seal between the wall 14 and the window 12, while at the same time trimming the appearance between window 12 and wall 14, without having any portion visible from the interior of the building in which the molding 10 is installed. This is best shown in FIG. 2 where the insulant 38 is shown compressed when in contact with the window 12 and wall 14, while the insulant 38 extends slightly into the gap 28 where not in contact with the building structure.

FIG. 4 is similar to FIG. 2 but shows a vertical wall section comprising the wall 14, vertical studs 40, and the exterior sheathing 20. Again, for installation tolerances, a gap 42 appears between the studs 40 and the window 12 and is trimmed, insulated and sealed by the molding 10 when installed as shown.

The molding 10, which preferably is of wood or similar material, may be affixed in a conventional manner by nailing to the window 12 and headers 18 or studs 40, as the case may be. As shown in FIG. 1 without being shown in greater detail, the molding 10 is also installed beneath the window 12 to seal any gap appearing there, as well. The molding 10 is cut in a conventional fashion from a long length of the molding (not illustrated), mitred as necessary, and then affixed in place. As is conventional, a stool 44 may be installed on the window 12 in combination with the molding 10 of the invention.

FIGS. 5 and 6 illustrate, in greater detail, the baseboard 16. In the wall section shown in FIG. 5, the building structure consists of the wall 14, base plates 46, the exterior sheathing 20 and the brick exterior 24. Beneath the typical building wall is a sub floor 48 and an additional support 50, such as a plate sitting on a foundation or the top portion of a lower storey. The sub floor 48 is topped by a finished floor 52 within the confines of the building and, usually, extends as close as practical to the wall 14. As is conventional, the juncture of the wall 14 and the finished floor 52 is finished by the baseboard 16.

The baseboard 16 comprises an elongated strip 54 having a facing side 56 and an insulating side 58. The facing side 56 is visible to the interior of the building in which it is installed, while the insulating side 58 is hidden from view.

An elongated channel 60 extending the length of the strip 54 is formed in the insulating side 58. In this embodiment of the invention, since the insulating side 58 comprises two orthogonal surfaces of the strip 54, the channel 60 is formed in both surfaces. A compressible insulant 62, identical to the insulant 38 decribed above, is installed in the channel 60, and extends outwardly from the strip 54 beyond each of the orthogoinal surfaces of the insulating side 58. Thus, when the baseboard 16 is installed as shown in FIG. 5, the insulant 62 butts against the wall 14 and the floor 52, sealing any gap between the two and preventing any air flow between the wall 14 and floor 52. In exactly the same fashion as the molding 10, the baseboard 16, by virtue of the outwardly extending portions of the insulant 62, accomodates any variances in the surface of the wall 14 or the floor 52. Also, since the width of the insulant 62 is considerably wider than any gap between the floor 52 and wall 14, the insulant can accommodate a wide variety of inconsistencies between the wall 14 and floor 52, such as chips or dents, small cut-out portions, and other inconsistencies which would differ from the ideally smooth surfaces of the wall 14 and floor 52 shown in FIG. 5.

In the same fashion as the molding 10, the baseboard 16 can be installed in a conventional fashion by nailing, screwing, or other means of affixing it to the wall 14 adjacent the floor 52.

ACHIEVEMENTS

The present invention provides a simple, yet effective construction tool for trimming, insulating and sealing between separate and disparate elements of a building structure. Not only do the molding 10 and baseboard 16 provide an asthetic trim in a conventional fashion, but also the protruding insulant, respectively 38 and 62, both insulates and seals gaps which it spans. Because the insulant is considerably wider than the gap over which it extends, and because the insulant is compressible, the invention can accomodate a wide variety of gaps and surface imperfections, while still forming a simple and effective seal.

Various changes can be made to the invention without departing from the spirit thereof or scope of the following claims.

What is claimed is:

1. A system for trimming, insulating and sealing between two separate and disparate elements of a building structure, which elements, due to construction tolerances, normally have a gap therebetween large enough to permit influx or egress of air, comprising a. an elongated strip having a facing side and an insulating side, said strip having a width greater than the width of said gap, such that said strip, when installed over said gap, bridges between said two elements with said insulating side, b. said facing side comprising a visible side of said strip to provide an asthetic trim between said building elements, c. said insulating side comprising an invisible side of said strip when installed, and including a channel extending the length of said strip, said channel having a width greater than the width of said gap, and having a particular depth, d. a compressible insulant disposed in and adhering securely to said channel, said insulant having a width greater than the width of said gap and said insulant having a thickness greater than the depth of said channel such that said insulant extends outwardly from said channel and protrudes from said insulating side to conform to and provide a seal upon contact with an element of building structure.

2. A system according to claim 1 in which said two elements of a building structure comprise a window and a wall, and said strip and insulant span an interior gap between the window and the wall.

3. A system according to claim 1 in which said two elements of a building structure comprise a door and a wall, and said strip and insulant span an interior gap between the door and the wall.

4. A system according to claim 1 in which said two elements of a building structure comprise a floor and a wall, and said strip and insulant span an interior gap between the floor and the wall.

5. A system according to claim 1 in which said insulating side comprises two generally orthogonal surfaces of said strip, said insulant extending outwardly from said channel beyond each of said surfaces.

6. A system according to claim 1 in which said insulant is adhesively secured in said channel.

7. A system according to claim 1 in which said insulant is a foamed insulant.

8. A system according to claim 1 in which the width of said insulant is generally equal to that of said channel.

9. A system according to claim 1 in which said insulating side is generally planar, and in which the portion of said insulant which extends outwardly from said channel includes a planar contact surface which is substantially parallel to said insulating side.

* * * * *